US007469701B1

(12) United States Patent
Bernard

(10) Patent No.: US 7,469,701 B1
(45) Date of Patent: Dec. 30, 2008

(54) METHOD AND APPARATUS FOR SECURING A HAIR EXTENSION

(76) Inventor: Marie Bernard, 111 NW. 6th Ave., Boca Raton, FL (US) 33432

( * ) Notice: Subject to any disclaimer, the term of this patent is extended or adjusted under 35 U.S.C. 154(b) by 155 days.

(21) Appl. No.: 11/347,156

(22) Filed: Feb. 3, 2006

(51) Int. Cl.
*A41G 3/00* (2006.01)

(52) U.S. Cl. ..... 132/201

(58) Field of Classification Search ..... 132/201, 132/207, 105, 53–56
See application file for complete search history.

(56) References Cited

U.S. PATENT DOCUMENTS 3,557,806 A * 1/1971 Blanchard ..... 132/101
2004/0079382 A1* 4/2004 Profitt-Campbell ..... 132/201
2006/0086368 A1* 4/2006 Salinas ..... 132/201

FOREIGN PATENT DOCUMENTS

JP 10-292216 * 11/1998

* cited by examiner

*Primary Examiner*—Robyn Doan
*Assistant Examiner*—Rachel A Running
(74) *Attorney, Agent, or Firm*—Oltman, Flynn & Kubler

(57) ABSTRACT

A method of mounting a hairpiece including a hairpiece strip of flexible sheet material and hairpiece strands secured to the strip using an anchor tube, includes the steps of providing anchor tube; parting wearer hair along a part line; placing the hairpiece strip against the part line; piercing the hairpiece strip to form a first hair port; drawing a first bundle of wearer hair strands outwardly through the first hair port; fitting the first bundle into the anchor tube and advancing the anchor tube along the first bundle into close proximity with the hairpiece strip; looping the first bundle back toward the strip and outward again through the anchor tube; tying the first bundle to the anchor tube; and crimping the anchor tube to engagingly grip the first bundle and thereby secure the hairpiece strip relative to the wearer scalp.

5 Claims, 4 Drawing Sheets

METHOD AND APPARATUS FOR SECURING A HAIR EXTENSION

BACKGROUND OF THE INVENTION

1. Field of the Invention

The present invention relates generally to the field of hair extensions and hair extension mounting methods. More specifically the present invention relates to a method of mounting what is known generally in the industry as a "hair extension", and is more descriptively referred to in this application as a hairpiece. The hairpiece includes a hairpiece strip of flexible sheet material known as a "polystrip" and having an upwardly opening central strip fold and hairpiece hair strands secured to the strip and extending laterally outward from the strip substantially perpendicular to the strip fold.

The method includes the steps of parting wearer hair along a part line having an upper side and a lower side; placing the strip against the part line so that the strip fold extends substantially parallel to and over the part line; piercing the strip at the strip fold with a piercing hook instrument, which preferably is a hook pin as described in this application, to form a first hair port substantially at the strip fold; hooking a first upper hair bundle from wearer hair on an upper side of the part line; hooking a first lower hair bundle from wearer hair on the lower side of the part line; drawing the first upper and first lower hair bundles outwardly from the scalp, and through the first hair port; combining the first upper and first lower hair bundles into a first combined bundle; piercing the strip at the strip fold with a piercing hook instrument to form a second hair port substantially at the fold and spaced, i.e. 5 millimeters, along the fold from the first hair port; hooking a second upper hair bundle from wearer hair on the upper side of the part line; hooking a second lower hair bundle from wearer hair on the lower side of the part line; drawing the second upper and lower hair bundles outwardly from the scalp through the first hair port; combining the second upper and second lower hair bundles into a second combined bundle; fitting the first and second combined bundles through the anchor tube and sliding the anchor tube along the first and second combined bundles into close proximity with the hairpiece strip; looping the collective free ends of the first and second combined bundles back through the anchor tube; tying the first and second combined bundles to the anchor tube; and crimping the anchor tube into a flattened configuration to engagingly grip the first and second combined bundles and thereby secure the hairpiece strip in close proximity to the wearer scalp and substantially against the wearer hair; and folding the wearer hair to close the part and to close the hairpiece along the strip fold. A spaced series of anchor tubes preferably are secured according to this method along the strip fold to anchor the full length of the strip. The method preferably additionally includes steps to adjust the proximity of the hairpiece relative to the wearer scalp periodically to compensate for hairpiece outward displacement as wearer hair grows.

2. Description of the Prior Art

There have long been hairpieces in the form of hair extensions for filling out thinning hair. These have been attached to the wearer hair with in ways which cause hair damage and do not permit removal and repositioning as wearer hair grows.

It is thus an object of the present invention to provide a method and apparatus for securing a hairpiece and specifically a strip hairpiece to wearer hair which is much faster than prior methods and which is painless.

It is another object of the present invention to provide such a method and apparatus for securing a strip hairpiece to wearer hair which permits readjustment of hairpiece anchoring means and thus readjustment of the hairpiece relative to a wearer scalp as wearer hair grows without hairpiece removal.

It is still another object of the present invention to provide such a method and apparatus which permits adjustment of the tightness of the hairpiece against the wearer scalp to meet the comfort, hair condition and style needs of the individual wearer.

It is finally an object of the present invention to provide such a method which can be practiced with minimal training and to provide such an apparatus for use with the method which is durable, reliable, safe and inexpensive to manufacture.

SUMMARY OF THE INVENTION

The present invention accomplishes the above-stated objectives, as well as others, as may be determined by a fair reading and interpretation of the entire specification.

A method of mounting a hairpiece including a hairpiece strip of flexible sheet material having an upwardly opening strip fold and hairpiece strands secured to the strip and extending laterally outward relative to the strip fold using an anchor tube is provided, including the steps of parting wearer hair along a part line; placing the strip against the part line so that the strip fold extends substantially parallel to and over the part line; piercing the strip at the strip fold with a piercing hook instrument, to form a first hair port substantially at the fold; hooking a first upper hair bundle from wearer hair on an upper side of the part; hooking a first lower hair bundle from wearer hair on the lower side of the part; drawing the first upper and first lower hair bundles outwardly from the scalp through the first hair port; combining the first upper and second upper bundles into a first combined bundle; piercing the strip at the strip fold with a piercing hook instrument to form a second hair port substantially at the fold and spaced along the fold from the first hair port; hooking a second upper hair bundle from wearer hair on the upper side of the part; hooking a second lower hair bundle from wearer hair on the lower side of the part; drawing the second upper and lower hair bundles outwardly from the scalp through the first hair port; combining the second upper and lower hair bundles into a second combined bundle; fitting the first and second combined bundles through the anchor tube and sliding the anchor tube along the first and second combined bundles into close proximity with the hairpiece strip; looping the collective free ends of the first and second combined bundles back toward the strip and outward again through the anchor tube; tying the first and second combined bundles to the anchor tube; and crimping the anchor tube to engagingly grip the first and second combined bundles and thereby secure the strip relative to the wearer scalp.

The method preferably includes the additional step of folding the wearer hair to close the part along the part line and to close the hairpiece along the strip fold. The method preferably is practiced using several anchor tubes, where the above method steps are repeated to secure a spaced series of the anchor tubes along the strip fold to anchor the hairpiece strip along its full length.

The method preferably includes the additional steps to adjust the proximity of the hairpiece relative to the wearer scalp periodically to compensate for hairpiece outward displacement as wearer hair grows, the additional steps including opening the flattened anchor tube; and one of: advancing the anchor tube to a desired proximity closer to the wearer scalp and crimping the anchor tube engagingly against the first and second combined bundles, and removing the anchor tube from the combined bundles and fitting and advancing the replacement anchor tube along the combined bundles to a desired proximity to the wearer scalp and crimping the replacement anchor tube engagingly against the combined bundles.

A method of mounting a hairpiece comprising a hairpiece strip of flexible sheet material and hairpiece strands secured to the strip using an anchor tube is further provided, including the steps of parting wearer hair along a part line; placing the hairpiece strip against the part line; piercing the hairpiece strip to form a first hair port; drawing a first upper bundle of wearer hair strands outwardly through the first hair port; drawing a first lower bundle of wearer hair strands outwardly through the first hair port; bringing first upper bundle and first lower bundle laterally together to form a first combined bundle; fitting the first combined bundle into the anchor tube and advancing the anchor tube along the first combined bundle into close proximity with the hairpiece strip; looping the first combined bundle back toward the strip and outward again through the anchor tube; tying the first combined bundle to the anchor tube; and crimping the anchor tube to engagingly grip the first combined bundle and thereby secure the hairpiece strip relative to the wearer scalp.

A method of mounting a hairpiece comprising a hairpiece strip of flexible sheet material and hairpiece strands secured to the strip using an anchor tube is still further provided including the steps of providing anchor tube; parting wearer hair along a part line; placing the hairpiece strip against the part line; piercing the hairpiece strip to form a first hair port; drawing a first bundle of wearer hair strands outwardly through the first hair port; fitting the first bundle into the anchor tube and advancing the anchor tube along the first bundle into close proximity with the hairpiece strip; looping the first bundle back toward the strip and outward again through the anchor tube; tying the first bundle to the anchor tube; and crimping the anchor tube to engagingly grip the first bundle and thereby secure the hairpiece strip relative to the wearer scalp.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
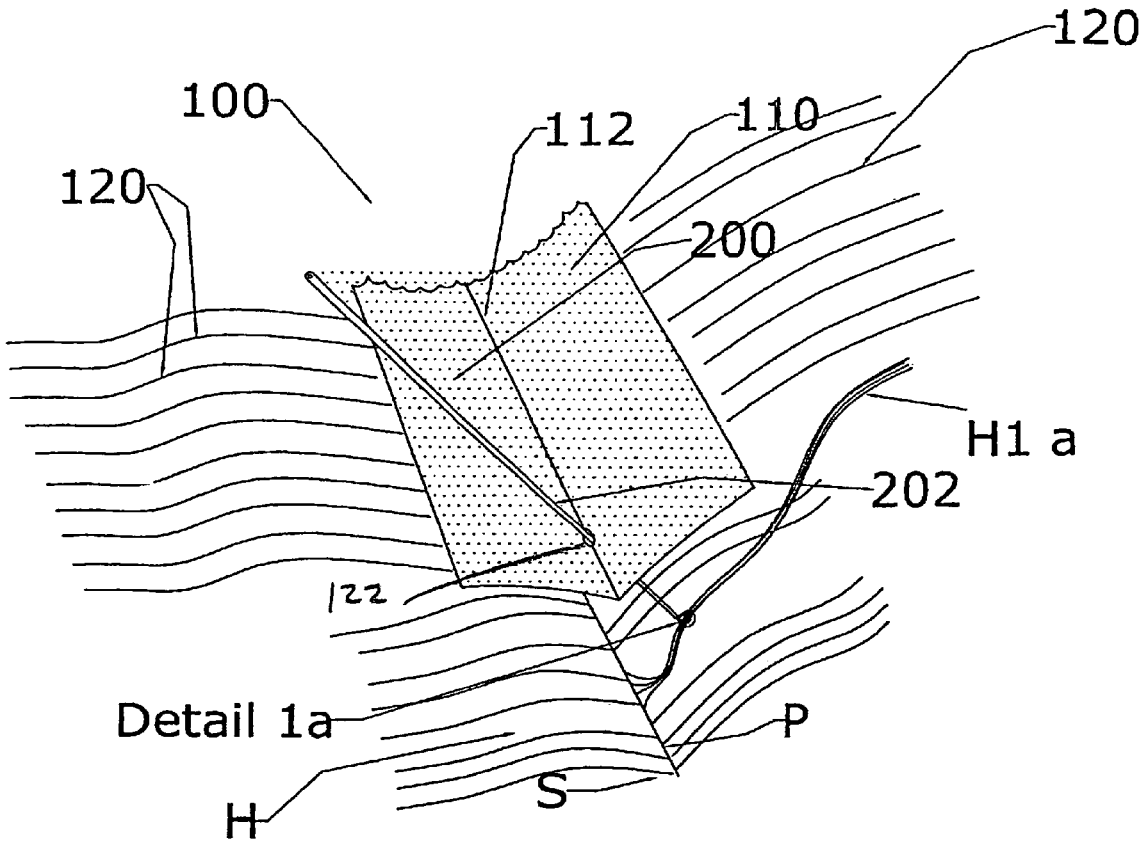
FIG. 1 is a perspective view of a wearer head fitted with a "hair extension" hairpiece, showing the hook needle penetrating the hairpiece strip and forming the first hair port, the needle hook needle engaging the first upper hair bundle.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
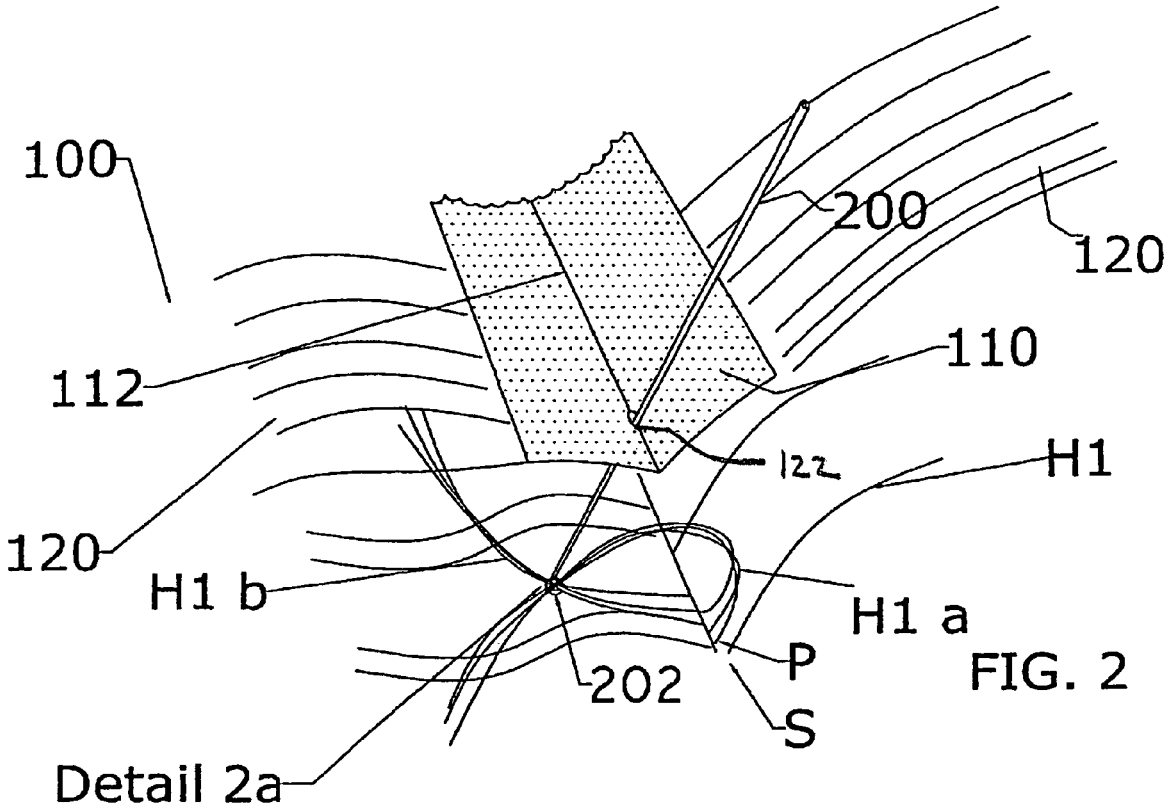
FIG. 2 is a view as in FIG. 1, showing the needle hook pivoted to the lower side of the part line and engaging the first lower hair bundle together with the already engaged first upper hair bundle, together defining the first combined bundle.
Figure 3:
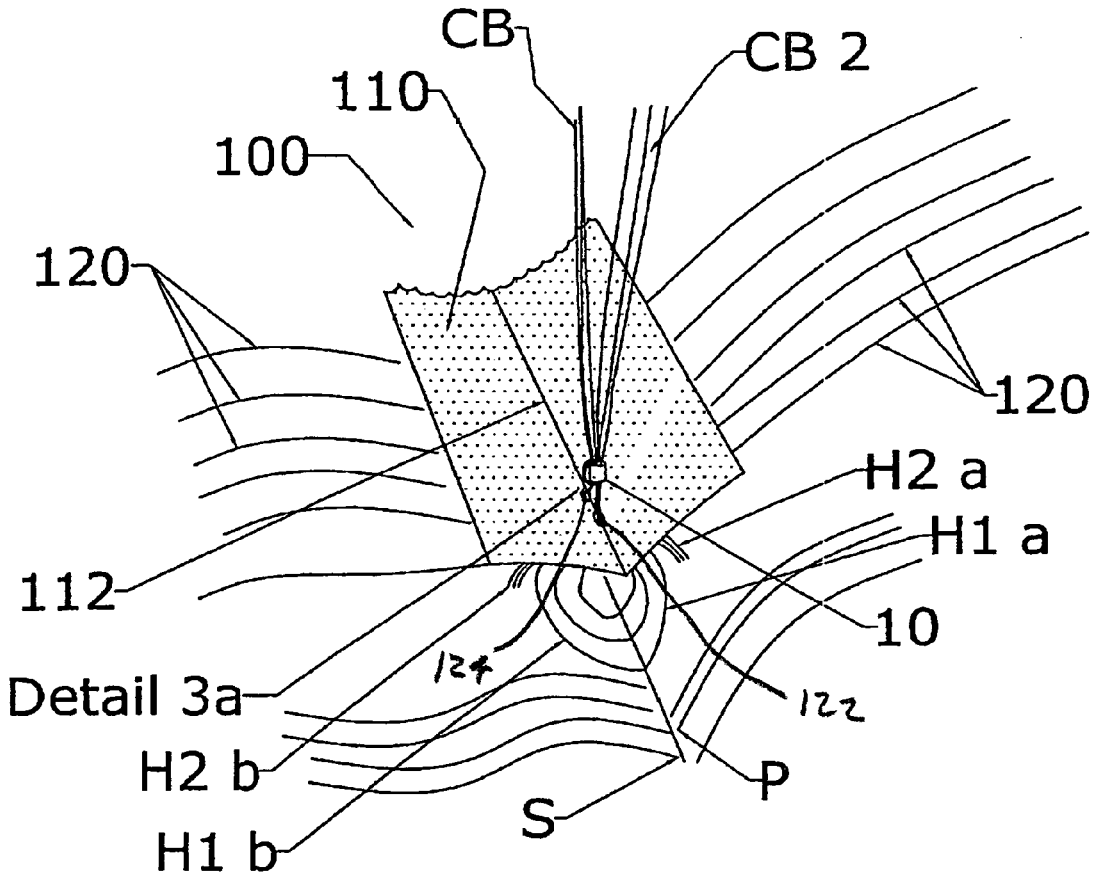
FIG. 3 shows the first combined bundle fitted through, and then looped back through and tied to an anchor tube, and a second upper hair bundle and a second lower hair bundle drawn through a second hair port defining the second combined bundle.
Figure 4:
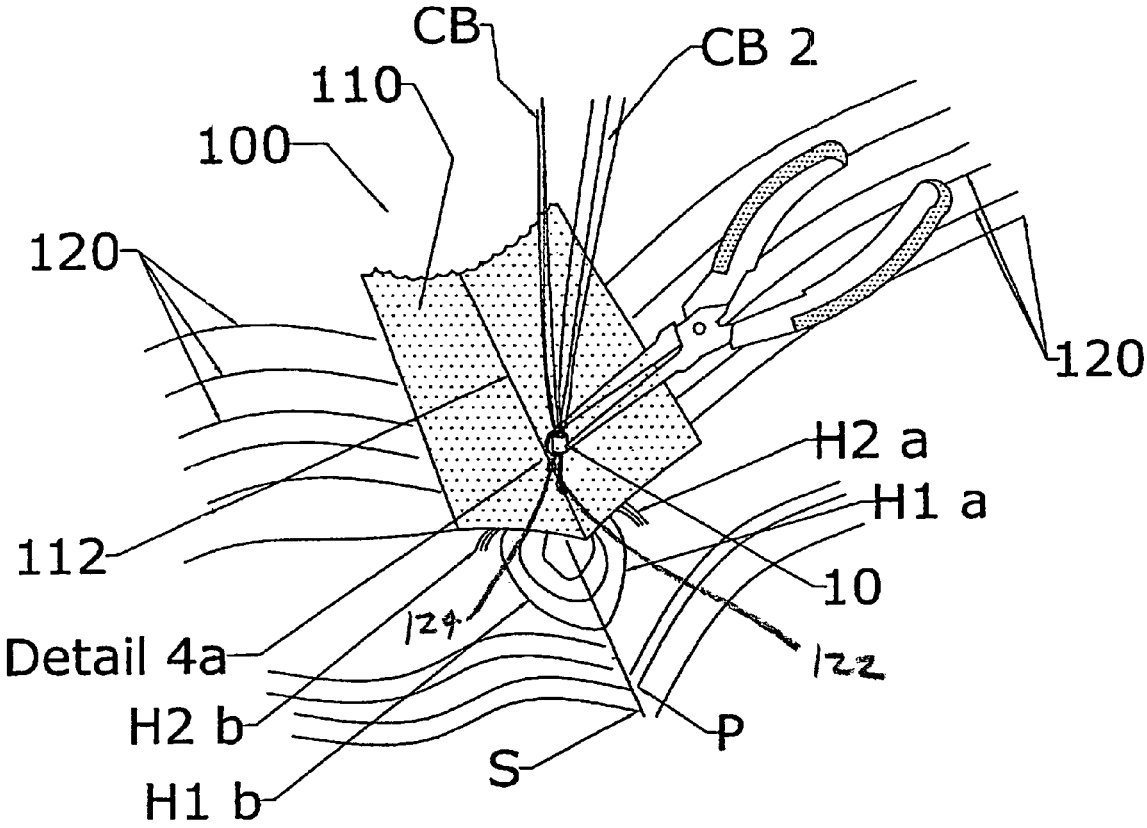
FIG. 4 shows the anchor tube being crimped engagingly against the first and second combined hair bundles.

Referring to FIGS. 1-4, an anchor tube 10 is disclosed in the form of a tube segment.

Method

In practicing the invention, the following method is used. The method of mounting a hairpiece 100 known as a "hair extension" including a hairpiece strip 110 of flexible sheet material known as a "polystrip" and having an upwardly opening central strip fold 112 and hairpiece strands of hair 120 secured to the strip 110 and extending laterally outward from the strip 110 substantially perpendicular to the strip fold 112 is provided using an anchor tube 10 and a piercing hook instrument which preferably is a hook pin 200 in the form of a narrow shaft with a hook end 202. The method includes the steps of providing anchor tube 10 and a hook pin 200; parting wearer hair H along a part line; placing the strip 110 against the part line so that the strip fold 112 extends substantially parallel to and over the part line; piercing the strip 110 at the strip fold 112 with a piercing hook instrument to form a first hair port 122 substantially at the fold; hooking a first upper hair bundle H1*a* from wearer hair H on an upper side of the part; hooking a first lower hair bundle H1*b* from wearer hair H on the lower side of the part; drawing the first upper and first lower hair bundles H1*a* and H1*b*, respectively, outwardly from the scalp S through the first hair port 122; combining the first upper and second upper bundles H1*a* and H1*b* into a first combined bundle CB1; piercing the strip 110 at the strip fold 112 with a piercing hook instrument to form a second hair port 124 substantially at the fold and spaced along the fold from the first hair port 122; hooking a second upper hair bundle H2*a* from wearer hair H on the upper side of the part; hooking a second lower hair bundle H2*b* from wearer hair H on the lower side of the part; drawing the second upper and lower hair bundles H2*a* and H2*b* outwardly from the scalp S through the first hair port 122; combining the second upper and lower hair bundles H2*a* and H2*b* into a second combined bundle CB2; fitting the first and second combined bundles CB1 and CB2 through the anchor tube 10 and sliding the anchor tube 10 along the first and second combined bundles CB1 and CB2 into close proximity with the hairpiece strip 110; looping the collective free ends of the first and second combined bundles CB1 and CB2 back toward the strip 110 and outward again through the anchor tube 10; tying the first and second combined bundles CB2 to the anchor tube 10; and crimping the anchor tube 10 into a flattened configuration to engagingly grip the first and second combined bundles CB1 and CB2, respectively, and thereby secure the strip 110 in close proximity to the wearer scalp S and against the wearer hair H; and folding the wearer hair H to close the part and to close the hairpiece 100 along the part line P and the strip fold 112. The distance of the secured anchor tube 10 from the hairpiece strip 110 can vary from no distance to several millimeters, depending on the requirements and preferences of the individual wearer. A spaced series of anchor tubes 10 preferably are secured according to this method along the strip fold 112 to anchor the full length of the strip 110. Optional additional steps include untying the first and second combined bundles CB1 and CB2 and retying the first and second combined bundles CB1 and CB2 adjacent the new location of the anchor tube 10.

The method preferably additionally includes steps to adjust the proximity of the hairpiece 100 relative to the wearer scalp S periodically to compensate for hairpiece 100 outward displacement as wearer hair H grows. These steps include opening the flattened anchor tube 10 and one of: advancing the anchor tube 10 to a desired proximity closer to the wearer scalp S and re-crimping the anchor tube 10 engagingly against the first and second combined bundles CB1 and CB2, and removing the anchor tube 10 from the first and second combined bundles CB1 and CB2 and fitting and sliding another anchor tube 10 along the first and second combined bundles CB1 and CB2 to a desired proximity to the wearer scalp S and crimping the anchor tube 10 engagingly against the first and second combined bundles CB1 and CB2.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of mounting a hairpiece comprising a hairpiece strip of flexible sheet material having an upwardly opening strip fold and hairpiece strands secured to the strip and extending laterally outward relative to the strip fold using an anchor tube, the method comprising the steps of:

parting wearer hair along a part line;

placing the strip against the part line so that the strip fold extends substantially parallel to and over the part line;

piercing the strip at the strip fold with a piercing hook instrument, to form a first hair port substantially at the fold;

hooking a first upper hair bundle from wearer hair on an upper side of the part;

hooking a first lower hair bundle from wearer hair on the lower side of the part; drawing the first upper and first lower hair bundles outwardly from the scalp through the first hair port;

combining the first upper and first lower bundles into a first combined bundle;

piercing the strip at the strip fold with a piercing hook instrument to form a second hair port substantially at the fold and spaced along the fold from the first hair port;

hooking a second upper hair bundle from wearer hair on the upper side of the part;

hooking a second lower hair bundle from wearer hair on the lower side of the part;

drawing the second upper and lower hair bundles outwardly from the scalp through the first hair port;

combining the second upper and lower hair bundles into a second combined bundle;

fitting the first and second combined bundles through the anchor tube and sliding the anchor tube along the first and second combined bundles toward the hairpiece strip;

looping the free ends of the first and second combined bundles back toward the strip and outward again through the anchor tube; tying the first and second combined bundles to the anchor tube;

and crimping the anchor tube to engagingly grip the first and second combined bundles and thereby secure the strip relative to the wearer scalp.

2. The method of claim 1, comprising the additional step of: folding the wearer hair to close the part along the part line and to close the hairpiece along the strip fold.

3. The method of claim 1, using a plurality of anchor tubes, wherein the method steps are repeated to secure a spaced series of the anchor tubes along the strip fold to anchor the hairpiece strip along its full length.

4. The method of claim 1, comprising additional steps to adjust the proximity of the hairpiece relative to the wearer scalp periodically to compensate for hairpiece outward displacement as wearer hair grows, the additional steps comprising:

opening the flattened anchor tube;

and one of: advancing the anchor tube to a desired proximity closer to the wearer scalp and crimping the anchor tube engagingly against the first and second combined bundles, and removing the anchor tube from the first and second combined bundles and fitting and advancing the replacement anchor tube along the combined bundles to a desired proximity to the wearer scalp and crimping the replacement anchor tube engagingly against the combined bundles.

5. A method of mounting a hairpiece comprising a hairpiece strip of flexible sheet material having an upwardly opening strip fold and hairpiece strands secured to the strip and extending laterally outward relative to the strip fold using an anchor tube, the method comprising the steps of:

parting wearer hair along a part line;

placing the strip against the part line so that the strip fold extends substantially parallel to and over the part line;

providing a first hair port substantially at the fold;

gathering a first upper hair bundle from wearer hair on an upper side of the part;

gathering a first lower hair bundle from wearer hair on the lower side of the part; drawing the first upper and first lower hair bundles outwardly from the scalp through the first hair port;

combining the first upper and first lower bundles into a first combined bundle;

providing a second hair port substantially at the fold and spaced along the fold from the first hair port;

gathering a second upper hair bundle from wearer hair on the upper side of the part;

gathering a second lower hair bundle from wearer hair on the lower side of the part;

drawing the second upper and lower hair bundles outwardly from the scalp through the first hair port;

combining the second upper and lower hair bundles into a second combined bundle;

fitting the first and second combined bundles through the anchor tube and sliding the anchor tube along the first and second combined bundles toward the hairpiece strip;

looping the free ends of the first and second combined bundles back toward the strip and outward again through the anchor tube; tying the first and second combined bundles to the anchor tube;

and crimping the anchor tube to engagingly grip the first and second combined bundles and thereby secure the strip relative to the wearer scalp.

* * * * *